United States Patent [19]

Cameron

[11] Patent Number: 4,754,582

[45] Date of Patent: Jul. 5, 1988

[54] TELEPHONE BOOTH WITH ADVERTISING DISPLAYS

[75] Inventor: Robert J. Cameron, Carmel, N.Y.

[73] Assignees: Flour City Architectural Metals, Div. of E. G. Smith Construction Products, Inc.; United Enclosures, Inc.; O. M. Edwards Company, Inc., all of Glen Cove, N.Y. ; a part interest to each

[21] Appl. No.: 18,808

[22] Filed: Feb. 20, 1987

Related U.S. Application Data

[63] Continuation of Ser. No. 763,548, Aug. 8, 1985, abandoned.

[51] Int. Cl.[4] ..... E04H 1/14

[52] U.S. Cl. ..... 52/27; 52/28; 52/38; D6/421; D6/555; D25/16

[58] Field of Search ..... 52/27, 36, 38, 79.1, 52/28; D25/16; D6/421, 555

[56] References Cited

U.S. PATENT DOCUMENTS

| | | | |
|---|---|---|---|
| D. 250,602 | 12/1978 | Ambrosio et al. | D25/16 |
| D. 257,416 | 10/1980 | King, Sr. | D25/16 |
| D. 263,101 | 2/1982 | George et al. | D25/16 |
| D. 275,632 | 9/1984 | Lebowitz | D6/421 |
| 2,821,038 | 1/1958 | Gee | D25/16 |
| 2,982,593 | 5/1961 | Chambers | 52/27 |
| 3,063,496 | 11/1962 | Kessler | 52/28 |
| 3,389,246 | 6/1968 | Shemitz | 52/28 X |
| 4,432,170 | 2/1984 | Hewell | 52/28 |
| 4,453,327 | 6/1984 | Clarke | 52/38 |

FOREIGN PATENT DOCUMENTS

| | | | |
|---|---|---|---|
| 2355975 | 2/1978 | France | 52/79.1 |

*Primary Examiner*—David A. Scherbel
*Assistant Examiner*—Richard E. Chilcot, Jr.
*Attorney, Agent, or Firm*—Walter J. Blenko, Jr.

[57] ABSTRACT

A telephone booth wherein the sidewalls are box-like enclosures each having one or more advertising displays. The displays are illuminated by a light source located in the interior of each enclosure and the same light source also serves to illuminate the interior of the booth. The sidewall enclosures have an openable panel which permits the advertising displays to be changed from time to time as well as permitting access to the light source.

5 Claims, 4 Drawing Sheets

TELEPHONE BOOTH WITH ADVERTISING DISPLAYS

This application is a continuation of my co-pending application Ser. No. 763,548 filed Aug. 8, 1985, now abandoned.

BACKGROUND OF THE INVENTION

This invention relates generally to booths or enclosures for public telephones, and has particular reference to a novel construction for a telephone booth wherein the booth sidewalls are fabricated so as to provide advantageous commercial advertising displays.

Through the years telephone booths have evolved from relatively dark and stuffy cubicles with folding doors to the modern, attractive open-front booth that is well lighted and airy. The present day booths, whether they be full length, wall or pedestal mounted, are usually constructed with single thickness sidewalls consisting of glass or plastic panels. These panels do not normally display printed or decorative matter other than that which indicates that the enclosure is a public telephone booth. A patentability search has not been conducted on the booth construction disclosed herein.

SUMMARY OF THE INVENTION

The present invention provides a novel construction for a telephone booth wherein the novelty principally resides in the booth sidewalls. These sidewalls are box-like enclosures each having one or more advertising displays. The displays are illuminated by a light source located in the interior of each enclosure and the same light source also serves to illuminate the interior of the booth. The sidewall enclosures are provided with an openable door or panel which permits the advertising displays to be changed from time to time as well as permitting access to the light source.

Constructing a telephone booth so that portions of its exterior can display advertising material in an eye catching, attractive manner is believed to be a novel concept having substantial commercial value. Thus, public phone booths are almost always found in high density travel areas such as airports and the exposure that the advertising displays receive is consequently very high also.

DESCRIPTION OF THE PREFERRED EMBODIMENTS

Figure 5:
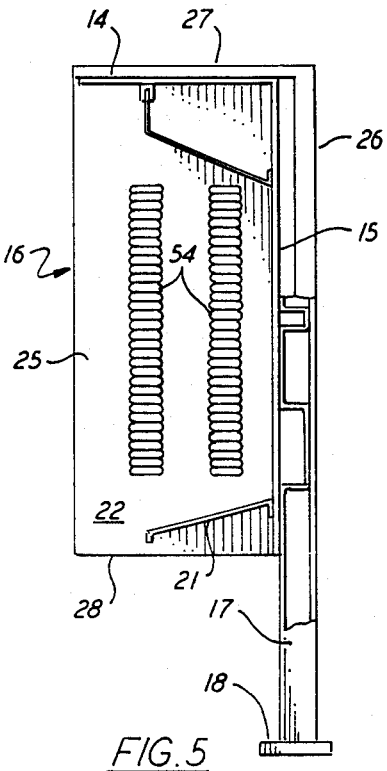
FIG. 5 is a vertical sectional view taken on line 5—5 of FIG. 2.

Referring now to the drawings, and with particular reference to FIGS. 1–4, the telephone booth of the present invention is essentially comprised of a top wall 14, back wall 15, and left and right sidewall enclosures indicated generally at 16. In the illustrated embodiment, this structure is supported by a pedestal 17 that includes a base plate 18 bolted or otherwise suitably secured to the floor. The telephone itself is normally mounted on the back wall 15 in the approximate location shown in phantom lines at 20. The interior of the booth is also provided with a conventional slanted writing shelf 21, FIGS. 1, 2 and 5.

The enclosures 16 that form the sidewalls of the booth are identical to each other and therefore only one need be described. Each enclosure has an inside and outside sidewall 22 and 23, a front edge wall 25, a rear edge wall 26 and top and bottom edge walls 27, 28. In accordance with the invention, the outside wall 23 has a large advertising display 30, to be described in more detail hereinafter, and the front and rear edge walls 25, 26 have smaller advertising or informational displays 31 and 32, FIGS. 1–4. The front edge display 31 can, for example, contain the names and phone numbers of area hotels and motels as a convenience to travelers in an airport, train or bus station. The large display 30 can advertise an airline, a particular hotel or resort, or other local attraction.

Figure 12:
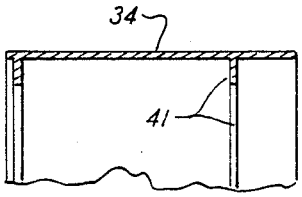
FIG. 12 is an enlarged sectional view through the aluminum extrusion that forms the outside frame of each sidewall enclosure.
Figure 7:
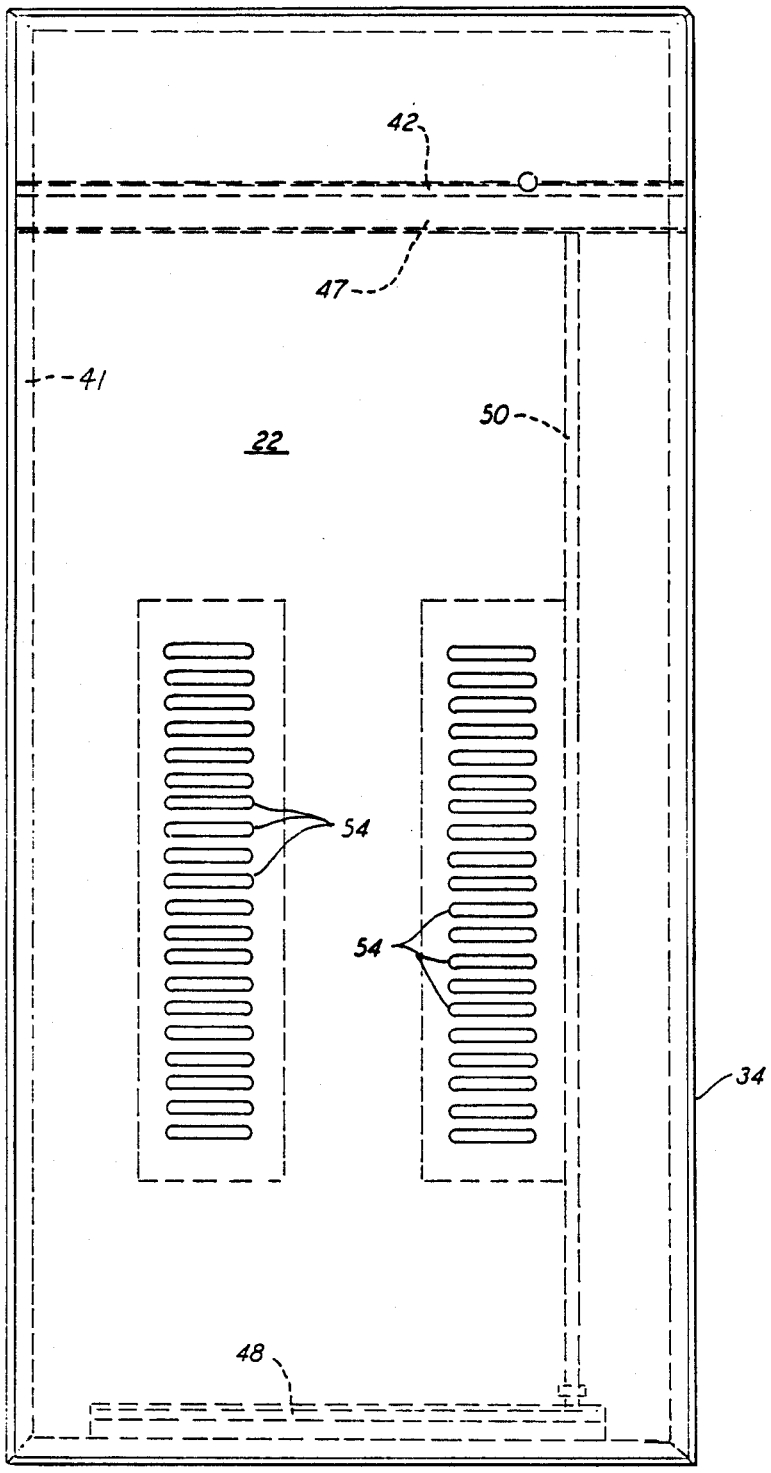
FIG. 7 is a greatly enlarged elevational view of the inside of one of the sidewall enclosures.
Figure 8:
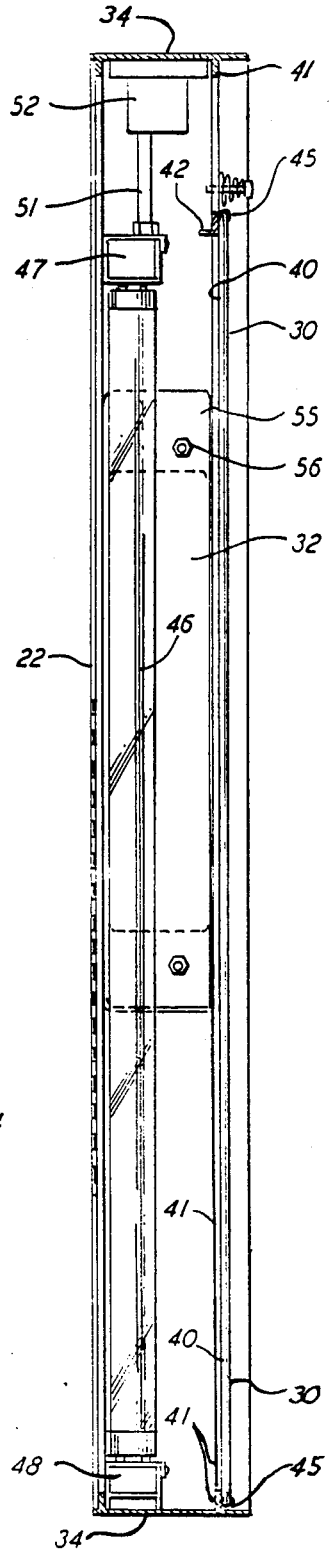
FIG. 8 is a vertical sectional view through an enclosure taken on line 8—8 of FIG. 6.
Figure 9:
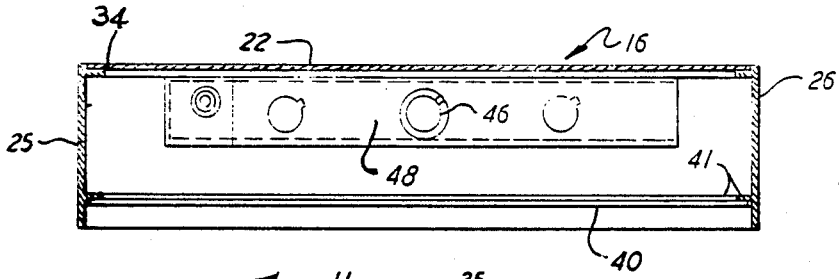
FIG. 9 is a horizontal sectional view through an enclosure taken on line 9—9 of FIG. 6.

The front and rear edge walls 25, 26 and top and bottom edge walls 27, 28 of the enclosure 16 are formed from a single, continuous aluminum extrusion 34, FIGS. 7, 8 and 12, that is bent into a rectangular frame. This frame is closed on its inner side by the inside wall 22 which in the embodiment shown is a sheet of aluminum. The outer side of the enclosure frame is normally closed by outside wall 23 which is a door or openable panel, FIGS. 1, 10 and 11, that permits access to the interior of the enclosure 16.

Figure 1:
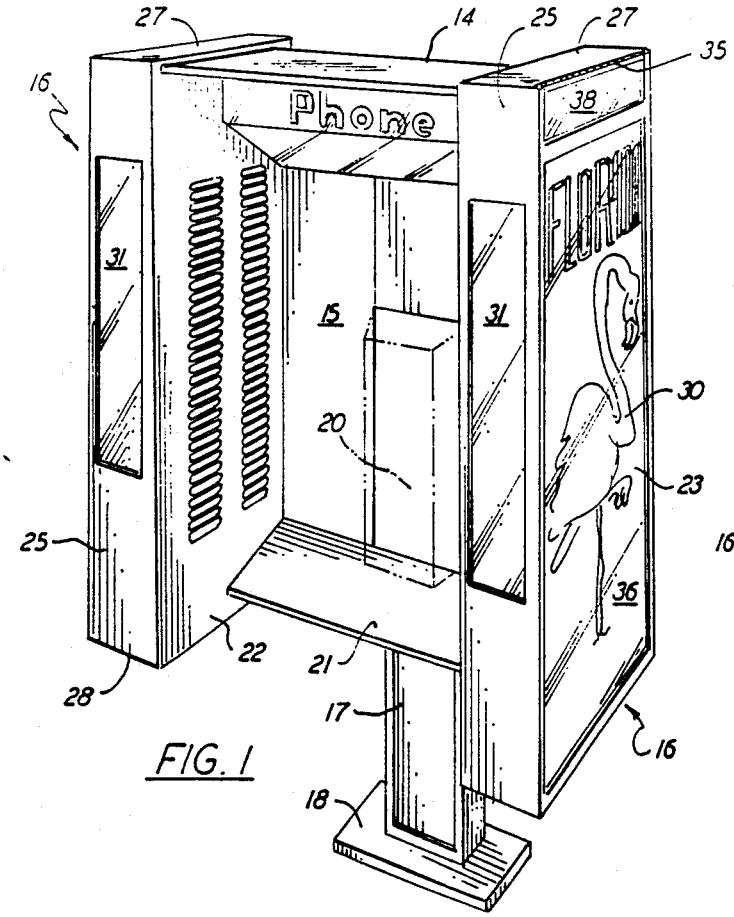
FIG. 1 is a front perspective view of a telephone booth embodying the present invention.
Figure 2:
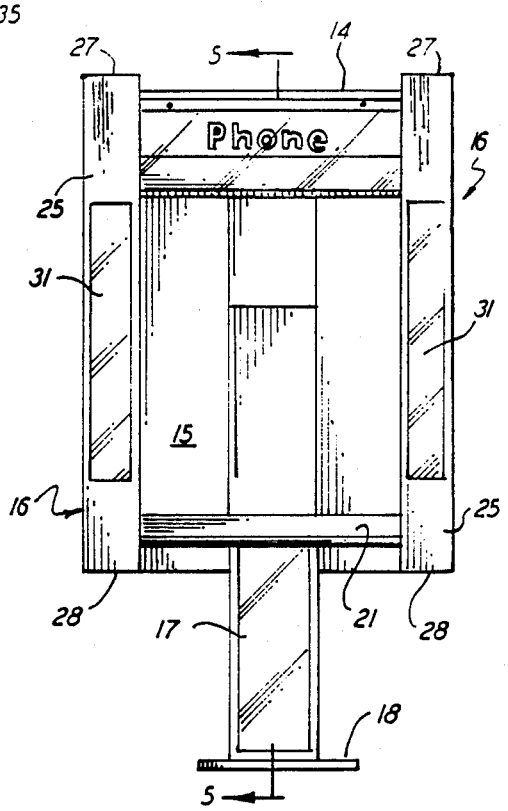
FIGS. 2, 3 and 4 are respectively a front elevation, a rear elevation and a side elevation of the booth on a reduced scale.
Figure 3:
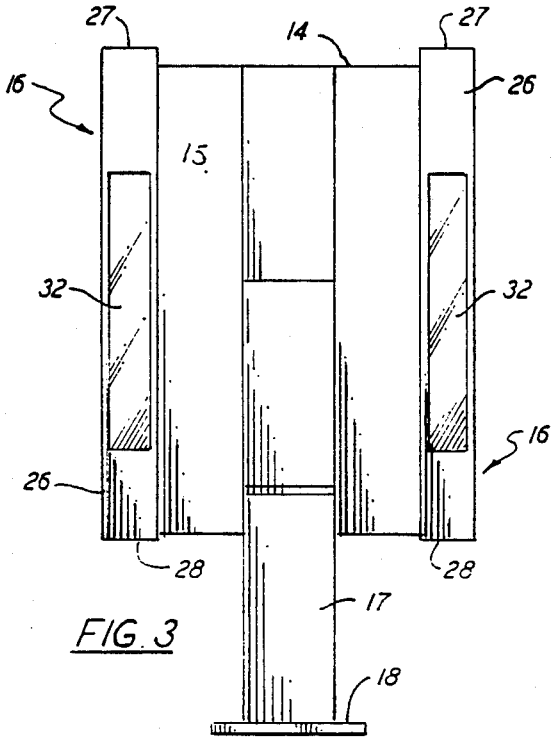
Figure 4:
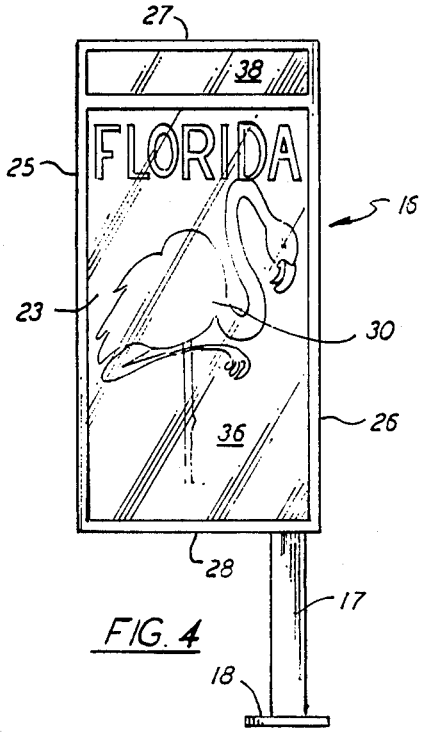
Figure 10:
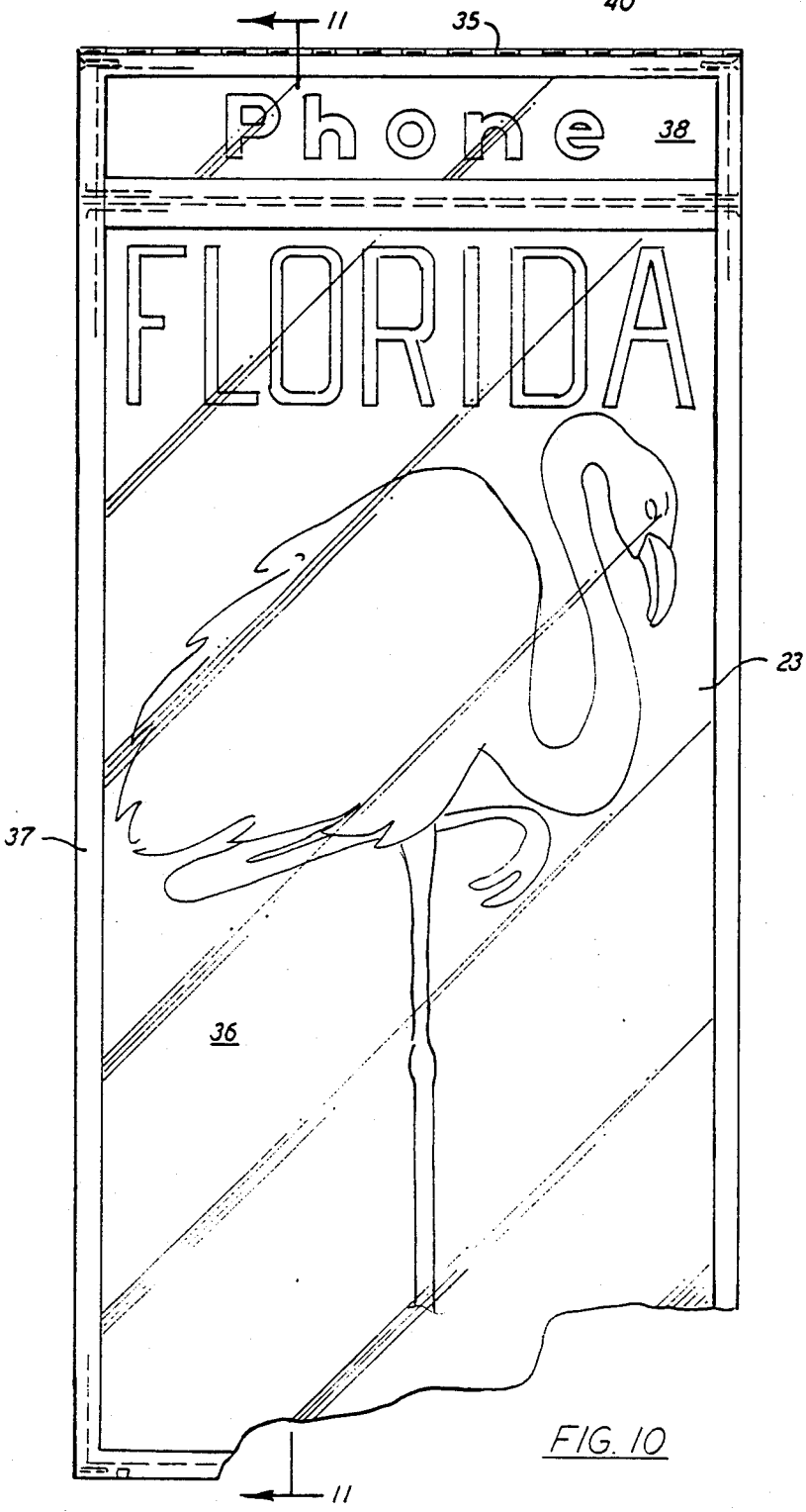
FIG. 10 is an elevational view of the door for one of the sidewall enclosures looking from the outside.
Figure 11:
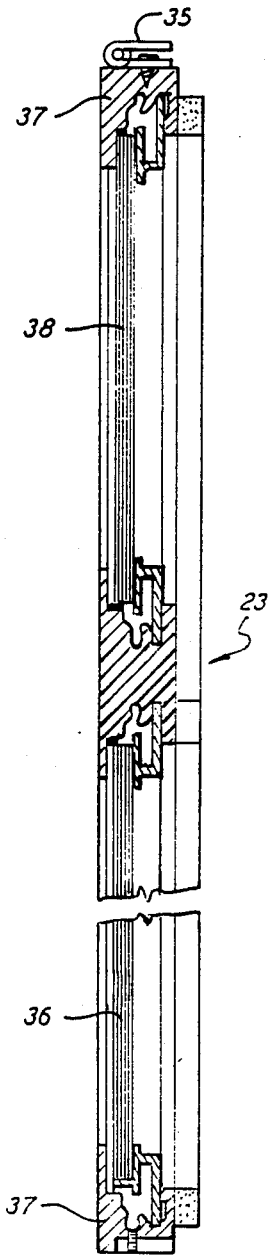
FIG. 11 is an enlarged, fragmentary vertical sectional view through the door taken on line 11—11 of FIG. 10.

The outside wall 23 is connected by a piano type hinge 35, FIGS. 1, 10 and 11, to the top edge wall 27 of the enclosure whereby the wall 23 opens from the bottom and can be swung upwardly for access to the enclosure interior. Wall 23 is normally retained in closed position by security screws, not shown. The wall or openable panel 23 is essentially comprised of a rigid sheet 36 of transparent material such as clear plastic or glass. The transparent sheet 36 is enclosed in an extruded aluminum frame 37, FIGS. 10 and 11, with conventional glazing means, and in the same manner the frame encloses an upper, smaller sheet 38 of plastic or glass that bears conventional phone booth indicia as shown Behind the transparent sheet 36 of wall 23, in the interior of the enclosure 16, there is a removable sheet 40 of translucent material, FIGS. 6 and 8, that serves as a backup sheet for the advertising display 30 which is usually a thin transparency. Adjacent its side and bottom edges, the backup sheet 40 abuts an inwardly projecting flange 41, FIGS. 8 and 12, on the extrusion 34 that forms the enclosure frame. Adjacent its top edge, the sheet 40 abuts an angle rail 42 that extends across the upper portion of the enclosure as best shown in FIGS. 7 and 8. The backup sheet 40 is releasably held in position in the enclosure 16 by mating "Velcro" fastener strips 44, FIG. 6, at the side edges of the sheet and on the flange 41 of the enclosure frame.

Figure 6:
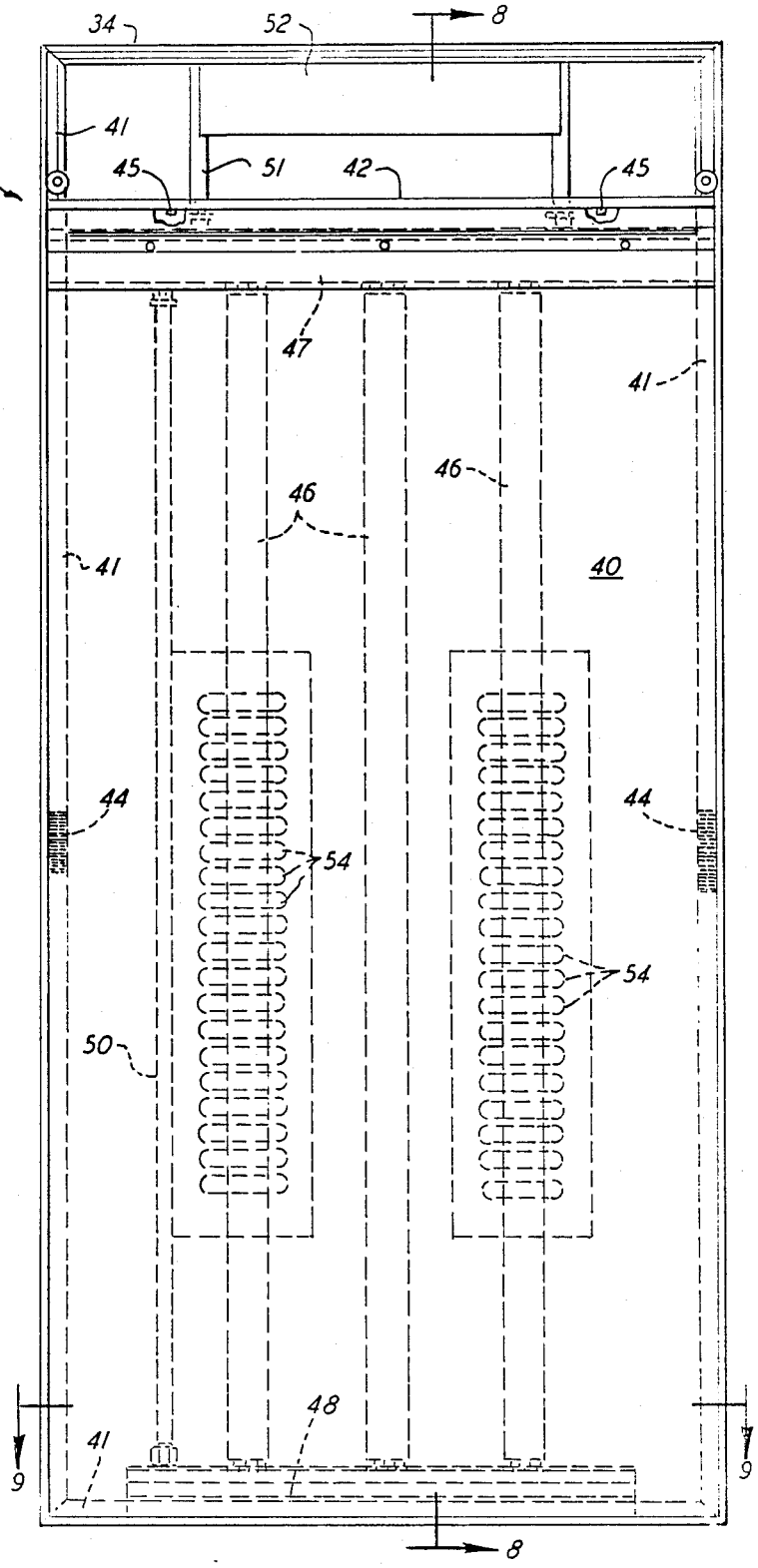
FIG. 6 is a greatly enlarged elevational view of the outside of the right hand sidewall enclosure with the openable outside wall removed.

The advertising transparency 30 referred to above is secured to its backup sheet 40 by metal clips 45 as indicated in FIGS. 6 and 8. Thus, when it becomes desirable from time to time to change the advertising display, the backup sheet is removed from the enclosure, the old display is removed therefrom and the new display is attached to the sheet using the clips 45.

The advertising displays 30, 31 and 32 are all illuminatd by the same light source which is located in the enclosure 16 behind the translucent backup sheet 40. In the embodiment of the invention disclosed, the light source consists of three fluorescent tubes 46, FIGS. 6 and 8. The ends of the tubes are plugged into upper and lower lampholders 47, 48 that are electrically connected together through electrical metal tubing 50. The upper lampholder 47 is also connected through tubing 51 to the ballast 52.

The light source for the displays 30, 31 and 32 can also be utilized to illuminate the interior of the phone booth. To this end, the inside wall 22 of the enclosure 16 is provided with louvres 54, FIGS. 1, 5, 6 and 7, which permit the light rays to enter the booth interior. In this connection, it should be understood that the number of fluorescent tubes 46 is not critical and that, alternatively, incandescent lamps can be employed as the light source.

The advertising or informational displays 31, 32 on the enclosure front and rear edge walls 25 and 26 are backed by diffuser sheets 55 of translucent material, FIG. 8, releasably secured in position by studs and nuts 56.

From the foregoing description it will be apparent that the invention provides a novel telephone booth construction that enables advertising material to be displayed in an eye catching, attractive manner. As will be understood by those familiar with the art, the invention may be embodied in other specific forms without departing from the spirit or essential characteristics thereof.

I claim:

1. In a telephone enclosure adapted for mounting on a pedestal and the like, said telephone enclosure comprising at least a backwall on which a telephone is mounted, a pair of vertical walls projecting forward from the backwall on each side of the telephone, the backwall and vertical walls extending vertically from a position above the telephone to a position which is below the telephone and is clear of the floor, and a shelf projecting out from the lower portion of the backwall, the improvement which comprises at least one vertical wall in the form of a box-like enclosure having inside and outside sidewalls, front and rear edge walls and top bottom edge walls, the outside sidewall being substantially open between opposed edges of its perimeter, a translucent sheet material covering the open area between the edges, said inside sidewall having a plurality of openings and said box-like enclosure having disposed within it light source means positioned between the outside sidewall and the inside sidewall whereby light from the light source means passes outwardly toward the outside sidewall to illuminate the translucent sheet material and also passes inwardly toward the inside sidewall to illuminate the inside of the telephone enclosure by passing through said plurality of openings to illuminate effectively the inside of said telephone enclosure and said shelf.

2. In a telephone enclosure adapted for mounting on a pedestal and the like, said telephone enclosure comprising at least a backwall on which a telephone is mounted, a pair of vertical walls projecting forward from the backwall on each side of the telephone, the backwall and vertical walls extending vertically from a position above the telephone to a position which is below the telephone and is clear of the floor, and a shelf projecting out from the lower portion of the backwall, the improvement which comprises at least one vertical wall in the form of a box-like enclosure having inside and outside sidewalls, front and rear edge walls and top and bottom edge walls, the outside sidewall being substantially open between opposed edges of its perimeter, a translucent sheet material covering the open area between the edges, said front edge wall being cut away over a substantial area, a translucent sheet material covering the cut away area, said inside sidewall having a plurality of openings, and said box-like enclosure having disposed within it light source means positioned to transmit light through all said openings whereby light from the light source means illuminates the outside sidewall and front edge wall to display effectively advertising material mounted on the translucent sheet material and light from the light source means illuminates the inside of the telephone enclosure by passing through said plurality of openings to illuminate effectively the inside of said telephone enclosure and said shelf.

3. In a telephone enclosure adapted for mounting on a pedestal and the like, said telephone enclosure comprising at least a backwall on which a telephone is mounted, a pair of vertical walls projecting forward from the backwall on each side of the telephone, the backwall and vertical walls extending vertically from a position above the telephone to a position which is below the telephone and is clear of the floor, and a shelf projecting out from the lower portion of the backwall, the improvement which comprises at least one vertical wall in the form of a box-like enclosure having inside and outside sidewalls, front and rear edge walls and top and bottom edge walls, the outside sidewall being in the form of a rectangular metal frame having a substantial open area, hinge means positioned along one edge of the frame and hingedly connecting the frame to the wall of the box-like enclosure for swinging movement of the frame away from the box-like enclosure, a sheet of transparent material mounted in the metal frame for swinging movement with the frame, a sheet of translucent material inserted within the box-like enclosure in a plane parallel to the plane of the outside sidewall, a sheet of transparent material having a design thereon mounted in the box-like enclosure intermediate the sheet of translucent material and the sheet of transparent material, and illumination means positioned within the box-like enclosure on the opposite side of the translucent sheet from the two sheets of transparent material.

4. The telephone enclosure of claim 3 in which lip means releasably hold the intermediate sheet of transparent material against the sheet of translucent material.

5. The telephone enclosure of claim 3 in which a plurality of openings are formed in the inside sidewall for transmission of light from the illumination means to the area adjacent the telephone.

* * * * *